US005894257A

United States Patent [19]

Roger et al.

[11] Patent Number: 5,894,257

[45] Date of Patent: Apr. 13, 1999

[54] ELECTROMAGNETIC TRIP FOR AN ELECTRICAL APPARATUS FOR PROTECTION

[75] Inventors: Patrick Roger, Auxonne; Robert Bet, Dijon, both of France

[73] Assignee: Schneider Electric SA, Boulogne Billancourt, France

[21] Appl. No.: 08/933,348

[22] Filed: Sep. 19, 1997

[30] Foreign Application Priority Data

Sep. 23, 1996 [FR] France ..... 95 11650

[51] Int. Cl.[6] ..... H01H 9/00

[52] U.S. Cl. ..... 335/172; 335/255; 335/251; 335/174

[58] Field of Search ..... 335/172–176, 335/255, 251, 273, 274

[56] References Cited

U.S. PATENT DOCUMENTS

| | | | |
|---|---|---|---|
| 3,509,505 | 4/1970 | Zagrzjewski . | |
| 4,677,409 | 6/1987 | Kozuka et al. | 335/258 |
| 4,698,609 | 10/1987 | Goehle et al. | 335/255 |

FOREIGN PATENT DOCUMENTS

| | | |
|---|---|---|
| 0335774 | 10/1989 | European Pat. Off. . |
| 0515292 | 11/1992 | European Pat. Off. . |
| 0538155 A1 | 4/1993 | European Pat. Off. . |
| 0569652 | 11/1993 | European Pat. Off. . |
| 2521774 | 8/1983 | France . |
| 2065375 | 6/1981 | United Kingdom . |

*Primary Examiner*—Michael L. Gellner
*Assistant Examiner*—Tuyen T. Nguyen
*Attorney, Agent, or Firm*—Oblon, Spivak, McClelland, Maier & Neustadt, P.C.

[57] ABSTRACT

An electromagnetic trip for an electrical switch apparatus for protecting against short circuits, including a magnetic yoke (20), a tubular non-magnetic coil form (40) with axis X–X', open at both ends (42, 43), a control coil (50) wound around the form (40), a fixed core (60) and a movable core (70) which are housed in the respective ends (42, 43) of the form (40), the movable core (70) having an upper end (72) projecting outside the form (40), characterized in that the form (40), the coil (50), the fixed core (60) and the movable core (70) constitute a pre-assembled electromagnetic sub-assembly (10) intended to be introduced into the magnetic yoke (20).

6 Claims, 3 Drawing Sheets

ELECTROMAGNETIC TRIP FOR AN ELECTRICAL APPARATUS FOR PROTECTION

This invention relates to an electromagnetic trip for an electrical apparatus, such as a circuit breaker, for protection against short circuit currents.

An electromagnetic trip appropriate for such an application, generally includes a magnetic yoke, a non-magnetic coil form, tubular and open at both of its ends, a control coil wound around the form, a fixed core and a movable core which are housed in the respective ends of the form, the movable core having an upper end projecting outside the form and a control lever mechanically linked to the movable core in order to trigger the opening of a power pole of the apparatus in response to a short circuit current.

Inevitably, nowadays, for serial manufacture, a reduction is being looked for in the number of fitting and/or assembly operations with a view to improving the manufacturing costs.

Hence the aim of the invention is to provide an electromagnetic trip which is fitted in a simple way and which is quickly assembled and can be quickly removed.

The trip according to the invention is characterised in that:

the coil form, the coil, the fixed core and the movable core constitute a pre-assembled electromagnetic sub-assembly intended to be introduced into the magnetic yoke, the fixed core has a lower end projecting outside form and provided with a groove, and the yoke includes a base and an upper portion, parallel in one and the same plane perpendicular to a longitudinal axis of the form, provided respectively with a lower slot and an upper slot which receive, by transverse sliding, respectively the groove of the fixed core and the upper end of the movable core.

According to one characteristic, the slots in the yoke are rectilinear and directed along axes contained within one and the same plane perpendicular to the plane of the base of the yoke, and are opposite to one another.

According to another characteristic, the magnetic yoke forms a cage with a closed outline in order to create a perfect closing off of the magnetic flux, the cage including two side arms which link the base and the upper portion.

According to another characteristic, the movable core is constituted by a magnetic plunger and, at its upper end, by a control rod with a narrower section than the plunger in a way that forms an intermediate shoulder, which is intended to abut against the lower face of the upper portion of the yoke in the at rest position of the movable core.

Advantageously, the shoulder creates a radial gap between the control rod and the form within a plane formed by the upper portion of the yoke, in order to allow the magnetic flux to pass with certainty, from the yoke to the plunger and not from the yoke to the control rod.

In order to perfect the intimate contact of the fixed core with the base of the yoke, bosses are provided on the upper face of the base and around the lower slot, for keeping the fixed core in the slot.

Other characteristics and advantages of the invention will become more apparent in the description which follows, with reference to the appended drawings given by way of example and in which FIG. 1 is a section view of an electromagnetic trip according to the invention with the movable core in the at-rest position:

Figure 1:
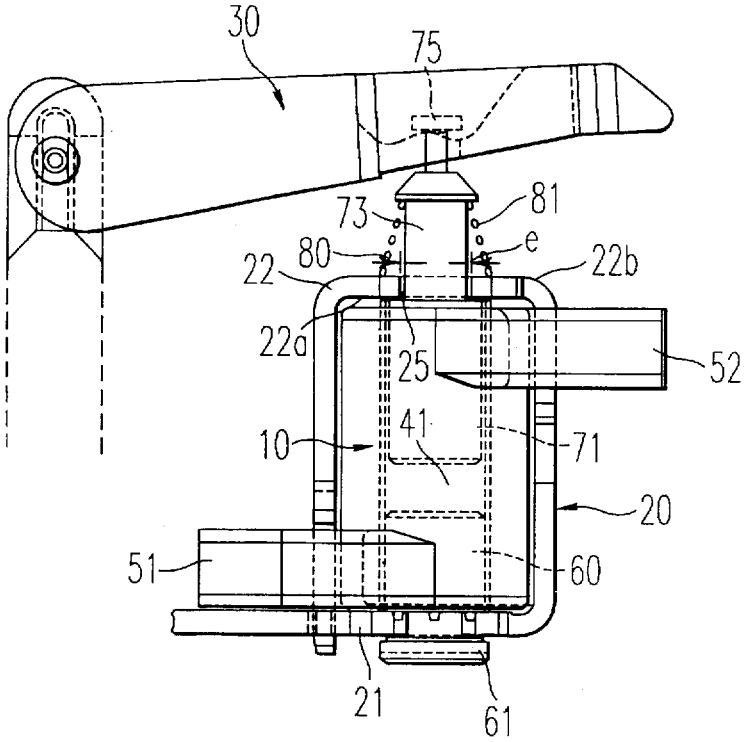
Figure 2:
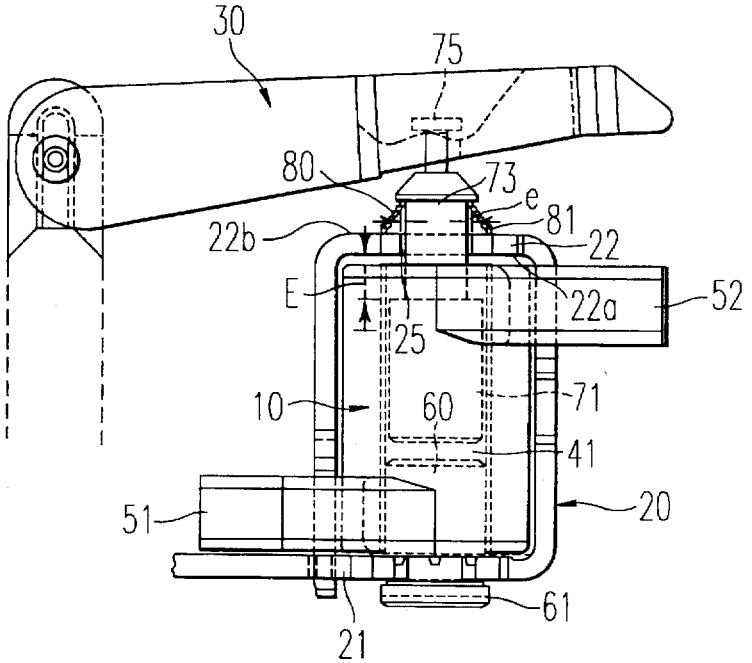
FIG. 2 shows FIG. 1 with the movable core in the attracted position.

The electromagnetic trip, illustrated in FIGS. 1 and 2, is intended to be integrated into an electrical apparatus, such as a circuit breaker, for protecting against short-circuit currents.

The trip includes an electromagnetic sub-assembly 10, a magnetic yoke 20 which is used as a support for the magnetic sub-assembly and a control lever 30 which is mechanically linked to the sub-assembly 10 and which is used to open a power pole of the circuit breaker in response to a short circuit current.

Figure 3:
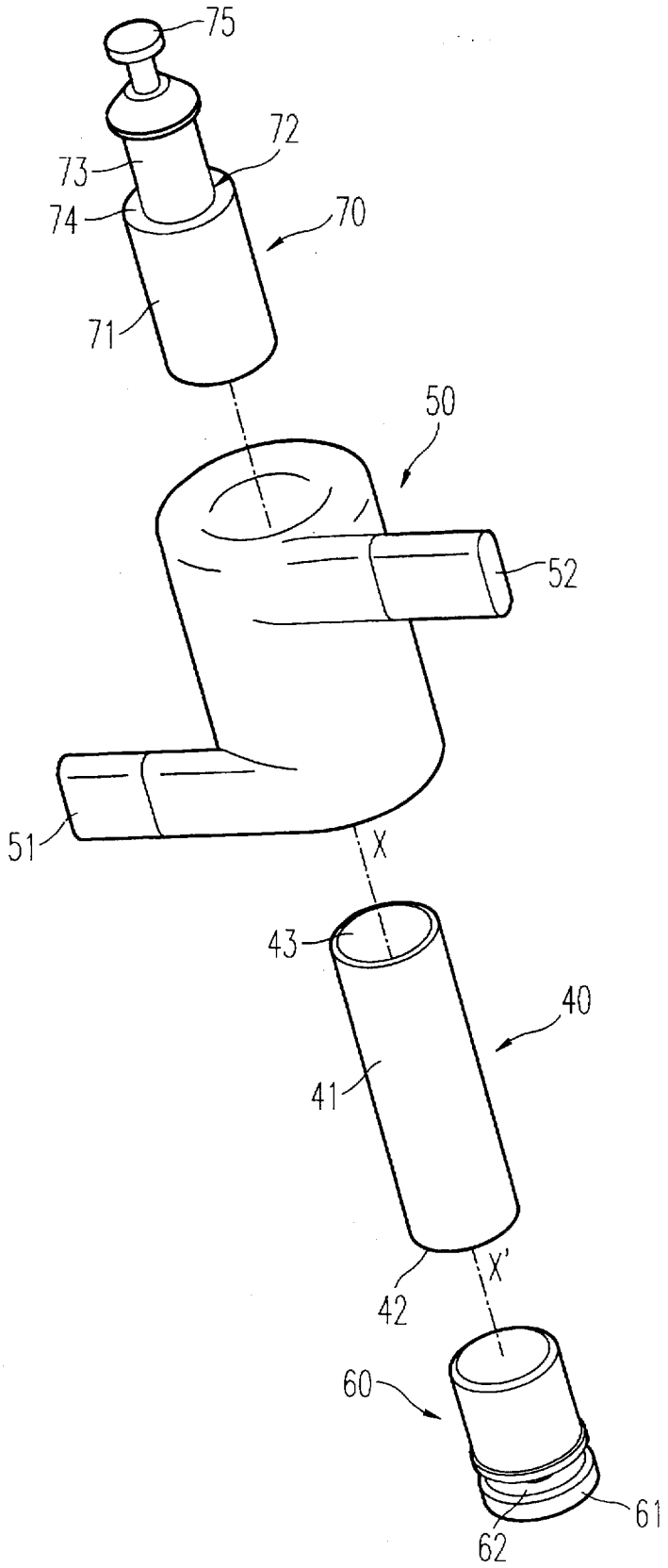
FIG. 3 is an exploded perspective view of the electromagnetic sub-assembly of the trip.

The electromagnetic sub-assembly 10, illustrated in FIG. 3, includes a non-magnetic coil form 40, a control coil 50 supported by the form 40 and a magnetic circuit constituted by a fixed core 60 and a movable core 70.

The coil form 40 is constituted by a cylindrical drum 41 with tubular axis X—X'. The drum is hollow and open at its two ends, the lower end 42 and the upper end 43.

The control coil 50 is wound around the cylindrical drum 41 of the coil form 40. It has two ends 51, 52 which are electrically connected, respectively, to a current input terminal, not shown and to a current output conductive part, not shown, of a power pole of the circuit breaker.

The magnetic circuit of the sub-assembly 10 is, in part, housed inside the non-magnetic drum 41.

The fixed core 60 of the magnetic circuit is of cylindrical shape; it is fitted and made integral with the lower end 42 of the drum by any appropriate means.

The core 60 has a lower end 61, outside the drum 41 and provided with a peripheral groove 62. In a variant of the invention, the peripheral groove 62 can be replaced by two symmetrically opposed lateral grooves.

The movable core 70 of the magnetic circuit is constituted by a cylindrical plunger 71 and, at its upper end 72, a control rod 73.

The plunger 71 is mounted to slide freely to the upper end 43 of the drum and is axially aligned with the fixed core 60.

The control rod 73 constitutes an axial extension of the plunger 71; in section it is narrower than the plunger so that an intermediate annular shoulder 74 is formed. With the movable core 70 in the at rest position, the shoulder 74 projects outside of the drum 41.

The control rod 73 is provided with a head 75 which is attached to the control lever 30 to carry out its release into the working position of the movable core 70.

A helical spring 80 for returning the movable core 70 to the at rest position is mounted around the rod 73 and is intended to be supported on the yoke 20.

Figure 4:
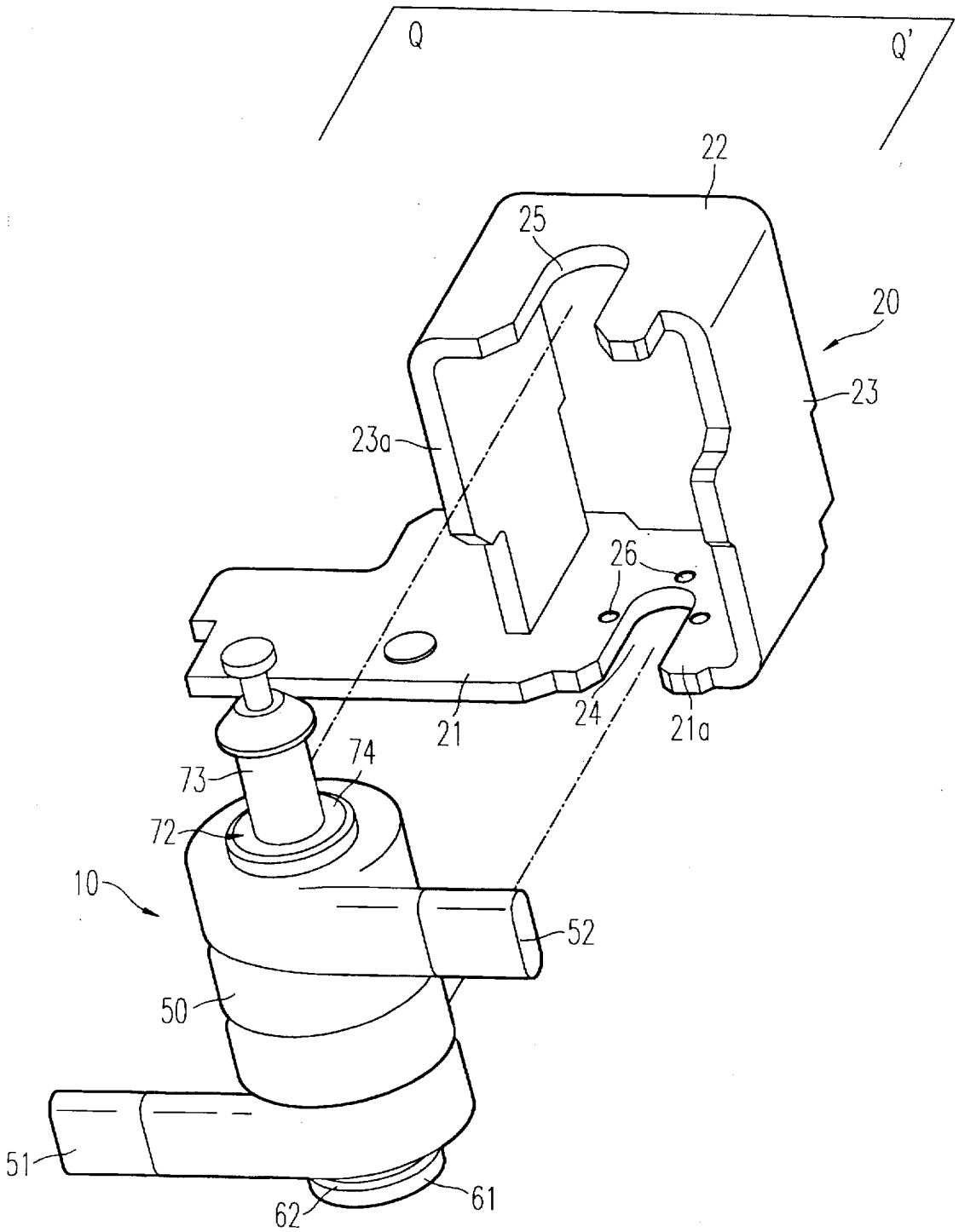
FIG. 4 is a perspective view of the magnetic sub-assembly and the magnetic yoke of the trip.

The magnetic yoke 20 comprises, as illustrated in FIG. 4, a base 21 and an upper portion 22 parallel to a plane QQ', linked to one another by at least one lateral arm 23. The yoke 20 preferably includes a second lateral arm **23*a* opposite the first arm 23** so that a single component is formed in the shape of a cage with a closed outline, which ensures perfect enclosure of the magnetic flux.

The base 21 and the upper portion 22 are provided respectively with a lower slot 24 and an upper slot 25. The slots 24, 25 are rectilinear and are directed along axes contained within one and the same plane perpendicular to the plane QQ', and are opposite one another.

The lower 24 and upper 25 slots are intended to co-operate respectively with the upper end 72 of the movable core 70 projecting from the drum 41 and with the groove 62 of the fixed core 60 to mechanically hold the magnetic sub-assembly 10 in the yoke 20. The groove 62 is fitted in the lower slot 24 so as to retain tightly the sub-assembly in the yoke 20 and to allow nevertheless removal of the subassembly.

The height separating the base 21 from the upper portion 22 is so dimensioned that the shoulder 74 of the movable core 70, with the latter in the at rest position, is in abutment against the lower face 22*a* of the upper portion 22 of the yoke in order to hold the plunger 71, which is being acted upon by return spring 80, in position and to connect it magnetically to the yoke 20. The spring 80 presses through its lower end 81 on the upper face 22*b* of the upper portion 22.

Furthermore, the control rod 73, of narrower section than the plunger, allows a radial gap e to be created between itself and the yoke 20 (FIGS. 1 and 2) so that the magnetic flux circulating between the yoke 20 and the movable core 70, in its at rest position, will assuredly pass through the plunger 71 and not through the rod 73. The radial gap e must however be less than the transverse gap E created between the upper portion 22 of the yoke 20 and the shoulder 74 of the movable core 70 when the latter is in the attracted position so that, in this position, the magnetic flux circulates immediately through the rod 73 then through the plunger 71 so as to create a maximum force of attraction between the movable core 70 and the fixed core 60.

Finally, the base 21 comprises, on its upper face 21*a* and around the lower slot 24, bosses 26 for holding the fixed core 61 in the slot 24 which serve to establish intimate contact for magnetic conduction between the fixed core 60 and the yoke 20 for good circulation of the magnetic flux.

The assembly of the magnetic sub-assembly 10 and its mounting in the yoke 20 are carried out in the following way:

The coil 50 is fitted around the cylindrical drum 41 of the coil form 40, the fixed core 60 is inserted in the lower end 42 of the drum 41 and the plunger 71 of the movable core 70 is introduced into the upper end 43 of the drum 41, the spring 80 having been previously fixed around the rod 73.

Once assembled, this sub-assembly is introduced into the yoke 20 parallel to the plane PP' in the direction of the lower 24 and upper 25 slots, the groove 62 of the fixed core 60 and the upper end 72 of the movable core 70 being inserted respectively into the lower slot 24 and into the upper slot 25 and the return spring 80 being compressed towards its upper end by means of a tool. Once the sub-assembly 10 has been fixed, the spring 80 is released so that its lower end 81 rests on the upper face 22*b* of the upper portion 22 of the yoke 20, the plunger 71 of the movable core being retained in the at rest position by the shoulder 74 abutting against the lower face 22*a* of the staged portion 22.

Finally, the control lever 30 is attached to the head 75 of the mobile core 70.

In an assembling variant, the spring 80 can be mounted on the rod 73 after fixing the sub-assembly 10 in the yoke 20, its fitting being facilitated by the conical shape of the upper end of the rod 73.

The location of the spring 80, on the outside of the yoke 20 permits its fitting at any time during the assembly of the trip, and facilitates access for its replacement without the need to dismantle the magnetic sub-assembly 10.

We claim:

1. An electromagnetic trip for an electrical switch apparatus to protect against short circuits, comprising:

a magnetic yoke;

a tubular non-magnetic coil form having an axis, said form being open at both ends;

a control coil wound about said form;

a fixed core and a movable core housed in opposite ends of said form, the movable core having an upper end projecting outside one end of the form and the fixed core having a lower end projecting out of an opposite end of the form, said lower end having an area of reduced diameter forming a groove in a plane perpendicular to said axis;

said form, said coil, said fixed core and said movable core forming a preassembled electromagnetic subassembly;

said yoke including a base and an upper portion parallel to said base, said base and said upper portion being perpendicular to said axis, said base having a lower rectilinear slot and said upper portion having an upper rectilinear slot, said slots being opposite one another and forming a plane perpendicular to the planes of said base and said upper portion;

a return spring fixed to said upper end positioned outside said yoke;

wherein said subassembly is received into said yoke by transverse sliding so that said groove is received into said lower rectilinear slot and said upper end of said movable core is received in said upper rectilinear slot.

2. An electromagnetic trip according to claim 1, characterised in that the magnetic yoke forms a cage with a closed outline that includes two side arms which link the base to the upper portion.

3. An electromagnetic trip according to claim 1, characterised in that the movable core is constituted by a magnetic plunger and, at its upper end, by a control rod narrower in section than the plunger in such a manner as to form an intermediate shoulder which is intended to abut against the lower face of the upper portion of the yoke in the at rest position of the movable core (70).

4. An electromagnetic trip according to claim 2, characterised in that the shoulder creates a radial gap between the control rod and the yoke in a plane formed by the upper portion.

5. An electromagnetic trip according to claim 4, characterized in that said return spring at its lower end rests on the upper face of the upper portion.

6. An electromagnetic trip according to claim 1, characterised in that the base includes bosses on its upper face and around the lower slot, to keep the fixed core in the slot.

* * * * *